United States Patent [19]

Nishijima

[11] Patent Number: 4,613,737

[45] Date of Patent: Sep. 23, 1986

[54] LOW PROFILE PUSHBUTTON SWITCH WITH TACTILE FEEDBACK

[75] Inventor: Akio Nishijima, Iwaki, Japan

[73] Assignee: Alps Electric Co., Ltd., Japan

[21] Appl. No.: 647,127

[22] Filed: Sep. 4, 1984

[30] Foreign Application Priority Data

Sep. 1, 1983 [JP] Japan ..... 58-159011

[51] Int. Cl.[4] ..... H01H 3/12

[52] U.S. Cl. ..... 200/340

[58] Field of Search ..... 200/159 B, 340

[56] References Cited

U.S. PATENT DOCUMENTS

| | | | |
|---|---|---|---|
| 4,153,829 | 5/1979 | Murata | 200/340 |
| 4,200,778 | 4/1980 | Bovio et al. | 200/159 B |
| 4,430,531 | 2/1984 | Wright | 200/159 B |
| 4,484,042 | 11/1984 | Matsui | 200/159 B |
| 4,486,637 | 12/1984 | Chu | 200/159 B |

*Primary Examiner*—Stephen Marcus
*Assistant Examiner*—Renee S. Luebke
*Attorney, Agent, or Firm*—Guy W. Shoup

[57] ABSTRACT

A pushbutton switch which includes a casing having a bottom wall and a top wall, and a switch device disposed in the casing on the bottom and composed of a relatively thin case having a flexible presser and accommodating a movable contact sheet, a spacer, and a fixed contact therein in stacked relation. A stem is disposed in the casing for movement toward and away from the switch device, and a plate spring is disposed above the flexible presser and curved toward the stem. An actuating member is disposed in the stem for movement toward and away from the switch device, and a spring is disposed between the actuating member and the stem for urging an upper portion of the stem to project through the top wall of the casing and also urge the actuating member into pressing contact with an upper surface of the plate spring. The flexible presser has on an upper surface a presser projection and on a lower surface a contact presser projection. When the stem is depressed the plate spring engages the presser projection, and displaces the contact presser toward a proximal end of the flexible presser away from the presser projection.

5 Claims, 9 Drawing Figures

LOW PROFILE PUSHBUTTON SWITCH WITH TACTILE FEEDBACK

BACKGROUND OF THE INVENTION

The present invention relates to a pushbutton switch of a low profile capable of producing a click when a switch device is actuated in response to depression of a switch stem.

There has been proposed a pushbutton switch having a thin switch device disposed vertically on a side of a casing and a stem disposed for vertical movement into and out of the casing for actuating the switch device. Such thin switch devices limit obtainable profile reductions which may be obtained in pushbutton switches, and it has been difficult to make the pushbutton switch thinner in configuration.

According to another proposal, a thin switch device is disposed horizontally on the bottom of a casing, and a stem arranged for vertical movement into and out of the casing is biased by a spring which projects outwardly from the casing. In such a pushbutton switch, the switch device can be actuated by being pushed by the stem when the stem is displaced against the switch device by the force of the spring.

The pushbutton switch of this type is of a low profile since the thin switch device is positioned horizontally on the bottom of the casing. With the low profile shape, however, the switch device is subjected to bouncing due to strong depression of the stem, which causes chattering, with the result that it takes a relatively long period of time for a current flowing through the switch device to reach a predetermined level, and pulsed currents tend to flow several times until the current reaches the predetermined level. It is desirable that such a chattering phenomenon be eliminated as it could adversely affect an electric circuit in which the pushbutton switch is incorporated.

It is also desirable that the pushbutton switch be of a low profile and also be capable of producing a definite click upon operation of the switch device to allow the operator to confirm the operation of the switch device in order to avoid malfunctioning thereof.

SUMMARY OF THE INVENTION

It is an object of the present invention to provide a pushbutton switch of a low profile having a switch device that does not chatter due to bouncing and is capable of producing a definite click upon operation.

According to the present invention, a pushbutton switch includes a casing having a bottom wall and a top wall, and a switch device disposed in the casing on the bottom wall and composed of a relatively thin case having a flexible presser and accommodating a movable contact sheet, a spacer, and a fixed contact therein in a stacked relation. A stem is disposed in the casing for movement toward and away from the switch device, a plate spring disposed above the flexible presser and curved toward the stem, an actuating member disposed in the stem for movement toward and away from the switch device, and a spring disposed between the actuating member and the stem for urging the stem to project an upper portion thereof through the top wall of the casing and also urging the actuating member into contact with an upper surface of the plate spring. The flexible presser has on an upper surface a presser projection and on a lower surface a contact presser projection. When the stem is depressed the actuating member deforms the plate spring, engages the presser projection, and displaces the contact presser toward a proximal end of the flexible presser away from the presser projection.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 5:
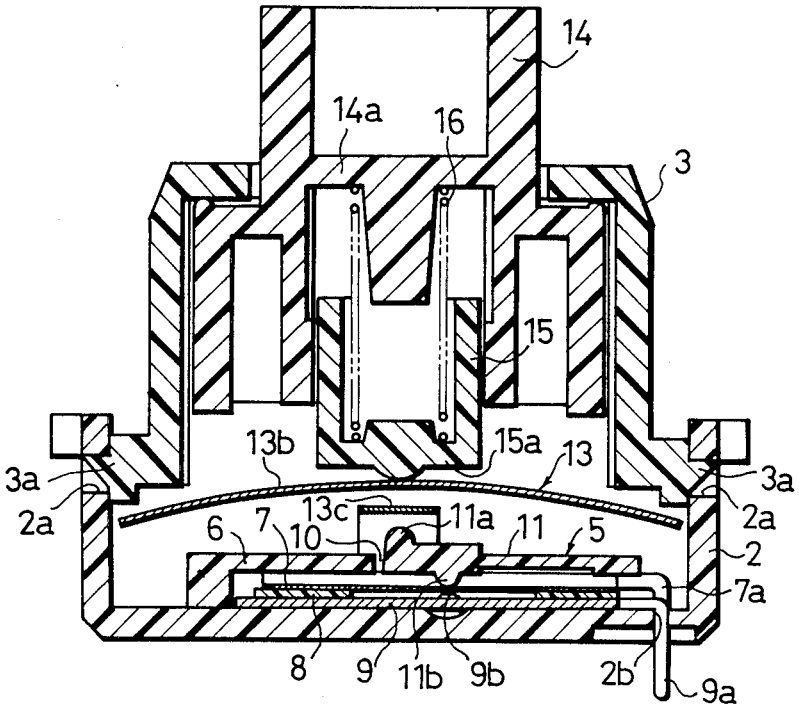
FIG. 5 is an enlarged cross-sectional view taken along line V—V of FIG. 1.
Figure 6:
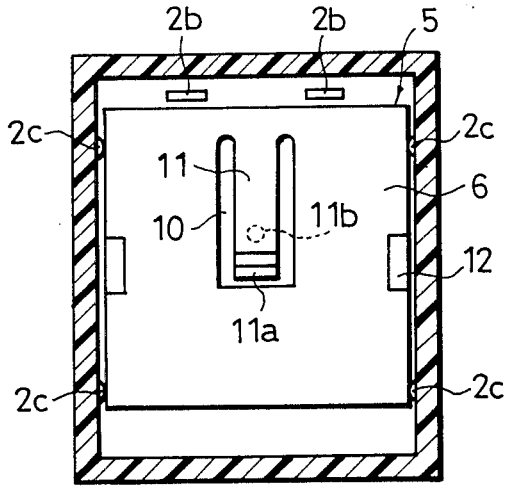
FIG. 6 is a transverse cross-sectional view of a lower case showing the disposition of a switch device.

A switch casing 1 is composed of a lower insulative case 2 of synthetic resin and an upper insulative case 3 of synthetic resin. As shown in FIG. 5, the upper case 3 is detachably held to the lower case 2 by locking projections 3*a* provided on lower end portions of the side walls of the upper case 3 and locked in respective locking holes 2*a* formed in upper end portions of the side walls of the lower case 2. The lower case 2 has a hole 2*b* defined in the bottom wall near one of the side walls for receiving terminals as will be described below. As illustrated in FIG. 6, the side walls of the lower case 2 have ribs 2*c* formed on inner surfaces at positions close to the corners of the lower case 2, the ribs 2*c* being contiguous to the bottom wall of the lower case 2.

Figure 8:
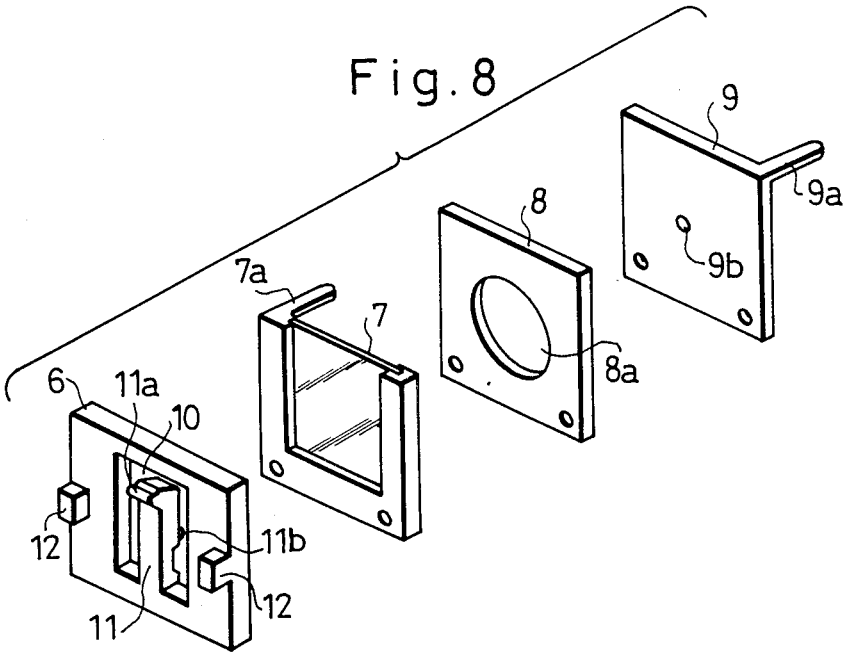
FIG. 8 is an exploded perspective view of the switch device.

A switch device 5 is disposed on the bottom wall of the lower case 2 and is guided into position by the ribs 2*c*. As shown in FIG. 8, the switch device 5 has a thin case 6 in which a movable contact sheet 7, an insulative spacer plate 8, and a fixed contact sheet 9 are accommodated as a stacked assembly.

The movable contact sheet 7 is made of a metal having good electric conductivity and high fatigue resistance, and is thin so as to be easily flexible. The fixed contact sheet 9 is of a thin configuration made of a material of good electric conductivity. The spacer plate 8 has a hole 3*a* defined therein which serves as a flexing space for the movable contact sheet 7. The movable contact sheet 7 can flex through the hole 8*a* toward and into contact with the fixed contact sheet 9.

The thin case 6 has a central opening for receiving a flexible presser 11 formed integrally with the side wall of the thin case 6. The flexible presser 11 has a presser projection 11*a* on an upper surface of a distal end thereof, and a contact presser projection 11*b* on a lower surface thereof, which is displaced away from the presser projection 11*a* toward a proximal end of the flexible presser 11. The thin case 6 also has a pair of seat portions formed at the centers of opposite marginal edges thereof. By pushing and displacing the flexible presser 11 toward the fixed contact sheet 9, the contact presser projection 11*b* causes the movable contact sheet 7 to flex through the hole 8*a* toward the fixed contact sheet 9. The movable contact sheet 7 is connected to a terminal 7*a*, while the fixed contact sheet 9 has an integral terminal 9*a*. These terminals 7*a*, 9*a* extend through the hole 2*b* in the bottom wall of the lower case 2. The fixed contact sheet 9 also has a central contact 9*b*.

Figure 1:
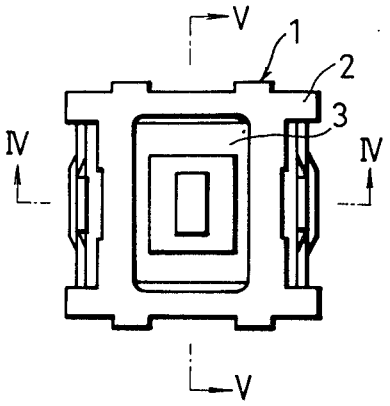
FIG. 1 is a plan view of a pushbutton switch according to the present invention.
Figure 2:
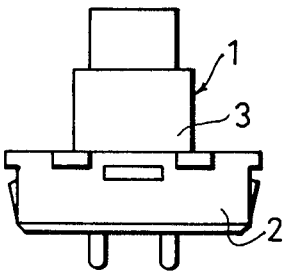
FIG. 2 is a front elevational view of the pushbutton switch.
Figure 3:
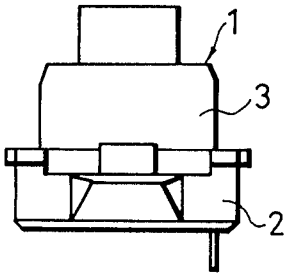
FIG. 3 is a side elevational view of the pushbutton switch.
Figure 4:
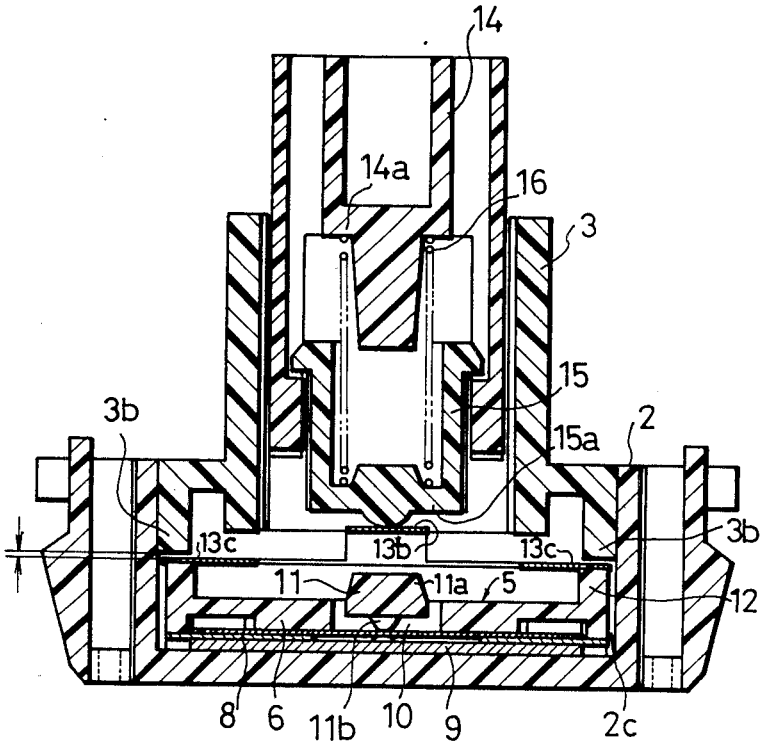
FIG. 4 is an enlarged cross-sectional view taken along line IV—IV of FIG. 1.
Figure 7:
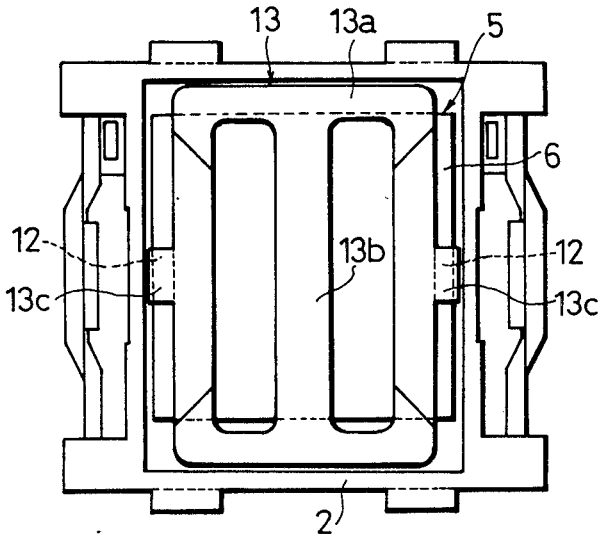
FIG. 7 is a plan view of the lower case illustrative of the disposition of a plate spring.

A plate spring 13 is disposed above the switch device 5 located on the bottom wall of the lower case 2, the plate spring 13 being convexed toward an actuating stem 14. The plate spring 13 comprises, as shown in FIGS. 4 and 7, a rectangular frame body 13*a*, a domed portion 13*b* extending between the centers of longitudinally opposite sides of the frame body 13*a*, and a pair of tongues 13*c* projecting laterally from the centers of transversely opposite sides of the frame body 13*a*. The tongues 13*c* are placed on the seat portions 12, respectively, of the thin case 6 with the domed portion 13*b* of the plate spring 13 being positioned above the switch device 5, as shown in FIG. 4. The tongues 13*c* placed on the seat portions 12 are positioned closely to legs 3*b* of the upper case 3 and spaced therefrom a distance of about 0.5 mm. Such a small distance serves to lengthen the service life of the plate spring 13. However, the function of the plate spring 13 would not be affected if the tongues 13*c* were held in contact with the legs 3*b* of the upper case 3.

A stem 14 has a lower portion disposed in the upper case 3 for moving toward and away from the lower case 2, i.e., toward or away from the switch device 5. The stem 14 has an upper portion projecting upwardly through a top wall of the upper case 3. A bottom cylindrical actuating member 15 is disposed in the lower portion of the stem 14 for movement toward and away from the plate spring 13. Between a bottom wall 15*a* of the actuating member 15 and a partition 14*a* of the stem 14, there is interposed a coil spring 16 for normally urging an upper portion of the stem 14 to project upwardly through the top wall of the upper case 3 and also urging the actuating member 15 into pressing contact with a central portion of an upper surface of the domed portion 13*b* of the plate spring 13.

Figure 9:
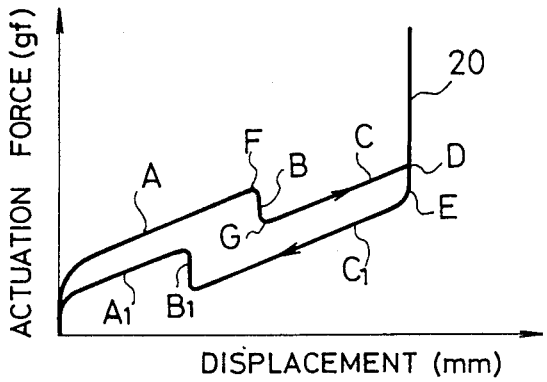
FIG. 9 is a diagram showing an actuation force curve of the pushbutton switch.

Operation of the pushbutton switch thus constructed is as follows:

As the stem 14 is displaced downwardly as shown in FIG. 5 against the spring force of the coil spring 16, the spring force of the coil spring 16 is gradually increased to increase a reactive force (actuation force) acting on the stem 14, represented by the slanted straight line A in FIG. 9. When the spring force of the coil spring 16 exceeds the resilient resistive force of the domed portion 13*b* of the plate spring 13 curved toward the stem 14, the domed portion 13*b* is quickly deformed inversely at its central portion toward the switch device 5, whereupon the coil spring 16 is abruptly extended and the actuation force of the stem 14 is reduced along a downward straight line F as shown in FIG. 9. The inverse deformation of the domed portion 13*b* allows the actuating member 15 to press the flexible presser 11, that is, the presser projection 11*a* of the switch device 5 through the domed portion 13*b*. The flexible presser 11 is caused to flex, thereby enabling the contact presser projection 11*b* to flex the movable contact sheet 7 through the hole 8*a* into contact with the fixed contact sheet 9, actuating the switch device 5. At the time the switch device 5 is actuated, a click is produced by the inverse deformation of the domed portion 13*b* of the leaf spring 13, allowing the operator to sense actuation of the switch device 5. As described above, the contact presser projection 11*b* is displaced toward the proximal end of the flexible presser 11 away from the presser projection 11*a* which is pushed by the actuating member 15. This arrangement permits the contact presser projection 11*b* to bounce to a lesser extent than the presser projection 11*a* as the flexible presser 11 bounces when it pushes the movable contact sheet 7 to flex toward the fixed contact sheet 9. Accordingly, the switch device 5 is less liable to suffer chattering.

When the stem 14 is further depressed, the spring force of the coil spring 16 is increased and the actuation force of the stem 14 is increased, as represented by the slanted straight line C in FIG. 9. As the coil spring 16 is fully compressed, the stem 14 can no longer be displaced, and the actuation force is thereafter sharply increased from a point D. Upon releasing the stem 14, the stem 14 returns to its original position under the spring force of the domed portion 13*b* of the plate spring 13 and the spring force of the coil spring 16. At this time, the actuation force varies successively along a straight line E, a slanted straight line $C_1$, a straight line $B_1$, and a slanted straight $A_1$ to the original state, as illustrated in FIG. 9. Therefore, the actuation force of the stem 14 follows a hysteresis loop 20 during one cycle of operation of the pushbutton switch. Designated in FIG. 9 at F is a point where the domed portion 13*b* starts being inversely deformed, and G a point where the switch device 5 is actuated.

While in the illustrated embodiment the curved frame-like plate spring 13 is employed, an inverted cup-shaped plate spring may instead be used, for example, as long as it is shaped to give a click through a snap action resilient deformation.

With the arrangement of the present invention, the pushbutton switch is of a low profile. The coil spring is disposed between the stem and the actuating member, and can be compressed by the stem. When the plate spring is pressed and deformed through the actuating member under the spring force of the spring, the plate spring is abruptly deformed inversely to turn on the switch device. The quick inverse deformation of the plate spring at the time the switch device is actuated allows the operator to sense operation by a feel of the snap action of the plate spring.

The contact presser projection on the lower surface of the flexible presser for flexing the movable contact sheet toward the fixed contact sheet is displaced toward the proximal end of the flexible presser away from the presser projection which is pressed by the actuating member. Therefore, the contact presser projection bounces to a smaller extent than the presser projection does at the time the flexible presser bounces, with the result that the switch device is less likely to undergo chattering.

Although a certain preferred embodiment has been shown and described, it should be understood that many changes and modifications may be made therein without departing from the scope of the appended claims.

What is claimed is:

1. A pushbutton switch comprising:

(a) a casing having a bottom wall and a top wall;

(b) a switch device disposed in said casing on said bottom wall and comprised of a relatively thin case having a flexible presser and accommodating a movable contact sheet, a spacer, and a fixed contact therein in stacked relation;

(c) a stem disposed in said casing for movement toward and away from said switch device;

(d) a plate spring disposed above said flexible presser and curved toward said stem;

(e) an actuating member disposed in said stem for movement toward and away from said switch device;

(f) a spring disposed between said actuating member and said stem for urging an upper portion of said stem to project through said top wall of said casing and also urging said actuating member into pressing contact with an upper surface of said plate spring;

(g) said flexible presser having on an upper surface a presser projection disposed near a free end of said flexible presser and on a lower surface a contact presser projection disposed further away from said free end, the stem when depressed causing said actuating member to deform the plate spring, which then engages said presser projection, and displaces it to force said contact presser to press said movable contact sheet toward said fixed contact.

2. A pushbutton switch according to claim 1, wherein said case of the switch device comprises an opening having said flexible presser disposed therein.

3. A pushbutton switch according to claim 1, wherein said plate spring comprises a rectangular frame body having longitudinally opposite sides and transversely opposite sides, a central domed portion extending between said longitudinally opposite sides, and tongues projecting from said transversely opposite sides and placed on said case of said switch device.

4. A pushbutton switch according to claim 3, wherein said casing is composed of an upper case and a lower case which are detachably assembled with each other, said switch device being disposed in said lower case, said upper case having legs disposed in said lower case and spaced slightly from said tongues, respectively.

5. A pushbutton switch according to claim 4, wherein said lower case has ribs on inner surfaces of side walls thereof, said switch device being disposed in said lower case and guided in position by said ribs.

* * * * *